US007984836B2

(12) United States Patent
Iwasaki

(10) Patent No.: US 7,984,836 B2
(45) Date of Patent: Jul. 26, 2011

(54) HANDICRAFT ASSISTING TOOL

(75) Inventor: Chihiro Iwasaki, Osaka (JP)

(73) Assignee: Clover Mfg. Co., Ltd., Osaka (JP)

( * ) Notice: Subject to any disclaimer, the term of this patent is extended or adjusted under 35 U.S.C. 154(b) by 411 days.

(21) Appl. No.: 12/287,120

(22) Filed: Oct. 6, 2008

(65) Prior Publication Data

US 2009/0288775 A1 Nov. 26, 2009

(30) Foreign Application Priority Data

May 23, 2008 (JP) ..... 2008-135211

(51) Int. Cl.
*A41H 33/00* (2006.01)
*A41H 3/08* (2006.01)

(52) U.S. Cl. ..... 223/38

(58) Field of Classification Search ..... 112/141–147, 112/117, 439; 493/162; 33/17 A, 11, 1 G, 33/563, 12, 13, 562, 565, 566; 223/3, 28–35, 223/37, 38

See application file for complete search history.

(56) References Cited

U.S. PATENT DOCUMENTS

| | | | | |
|---|---|---|---|---|
| 2,124,650 | A * | 7/1938 | Chessler | 112/427 |
| 3,694,818 | A * | 10/1972 | Nielson | 112/475.09 |
| 5,531,176 | A * | 7/1996 | Johnson | 112/475.24 |
| 6,067,722 | A * | 5/2000 | Goodyer et al. | 33/758 |
| 7,238,406 | B2 * | 7/2007 | Peterson | 428/137 |
| 7,281,337 | B1 * | 10/2007 | Oehlke et al. | 33/566 |
| 7,448,142 | B2 * | 11/2008 | Geier | 33/566 |

OTHER PUBLICATIONS

Mary Jo Hiney. *Quiltagami: The Art of Fabric Folding*, p. 20. Sterling Publishing Co., Inc., 2002.

* cited by examiner

*Primary Examiner* — Ismael Izaguirre
(74) *Attorney, Agent, or Firm* — Hamre, Schumann, Mueller & Larson, P.C.

(57) ABSTRACT

A handicraft assisting tool for folding a fabric into a configuration having rotational symmetry is provided. The handicraft assisting tool includes a flexible sheet body adhered to the fabric and a folding facilitator formed at the sheet body. The folding facilitator facilitates an operation of folding an overlapped product, which is obtained by adhering the fabric to the sheet body, along a predetermined folding line. The folding facilitator includes, for example, a plurality of slits disposed along the predetermined folding line.

15 Claims, 12 Drawing Sheets

HANDICRAFT ASSISTING TOOL

BACKGROUND OF THE INVENTION

1. Field of the Invention

The present invention relates to a handicraft assisting tool suitably used in patchwork and other handicraft field.

2. Description of the Related Art

An origami quilt has been conventionally known in a handicraft field. An origami quilt is for creating a motif by folding a fabric material as in origami (see, for example, "Quiltagami", Mary Jo Hiney, Sterling Publishing Co., Inc.). A motif is created, for example, by the following procedure. First, marks are put on cut sections of a fabric using a paper pattern, and then the fabric is cut into a predetermined size. Next, the fabric is folded a plurality of times according to a predetermined procedure. In so doing, the folded sections are ironed to form creases. An appropriate section is stitched subsequently to these folding work and ironing work to obtain a desired motif.

In the creation of a motif using the above-described conventional method, however, the fabric needs to be ironed in every folding step, thereby requiring extremely long time to create one motif. Moreover, because the fabric is weak in stiffness, it is difficult to form appropriate creases using an iron.

SUMMARY OF THE INVENTION

The present invention has been proposed under the circumstances described above. Therefore, it is an object of the present invention to provide a handcraft assisting tool that is used for simply and efficiently creating a motif used in an origami quilt.

A handicraft assisting tool provided by the present invention is used when folding a fabric into a configuration having rotational symmetry. The handicraft assisting tool includes a flexible sheet body adhered to the fabric, and a folding facilitator formed on the sheet body. The folding facilitator facilitates an operation of folding an overlapped product along a predetermined folding line, where the overlapped product is obtained b y adhering the fabric to the sheet body.

Preferably, the folding facilitator may include a plurality of slits disposed along the folding line.

The sheet body may preferably be provided with a plurality of number signs indicating an order of folding the overlapped product and a plurality of arrow signs indicating directions in which the overlapped product is to be folded.

The sheet body may preferably have an outline shaped as a regular polygon.

The sheet body may preferably include a central region in a similar shape to the regular polygon and a peripheral region surrounding the central region, where the folding facilitator includes a plurality of first slits disposed along a boundary between the central region and the peripheral region.

Preferably, the folding facilitator may further include a plurality of second slits formed in the peripheral region, where one of the plurality of second slits and one of the plurality of first slits are disposed collinear.

The, central region may preferably be half the size of the sheet body, and a straight line passing through one apex of the central region and a corresponding apex of the sheet body passes through a center of the sheet body.

Preferably, the handicraft assisting tool of the present invention may further include a release sheet attached to the sheet body. Also, the sheet body may be provided with an adhesive layer to be adhered to the fabric and the release sheet.

According to a preferred embodiment of the present invention, the sheet body may include a nonwoven layer and a thermal adhesive layer laminated on the nonwoven layer.

Other features and advantages of the present invention will become apparent from the following detailed descriptions with reference to the accompanying drawings.

DETAILED DESCRIPTION OF THE PREFERRED EMBODIMENT

Preferred embodiments of the present invention will be described below with reference to the accompanying drawings.

Figure 1:
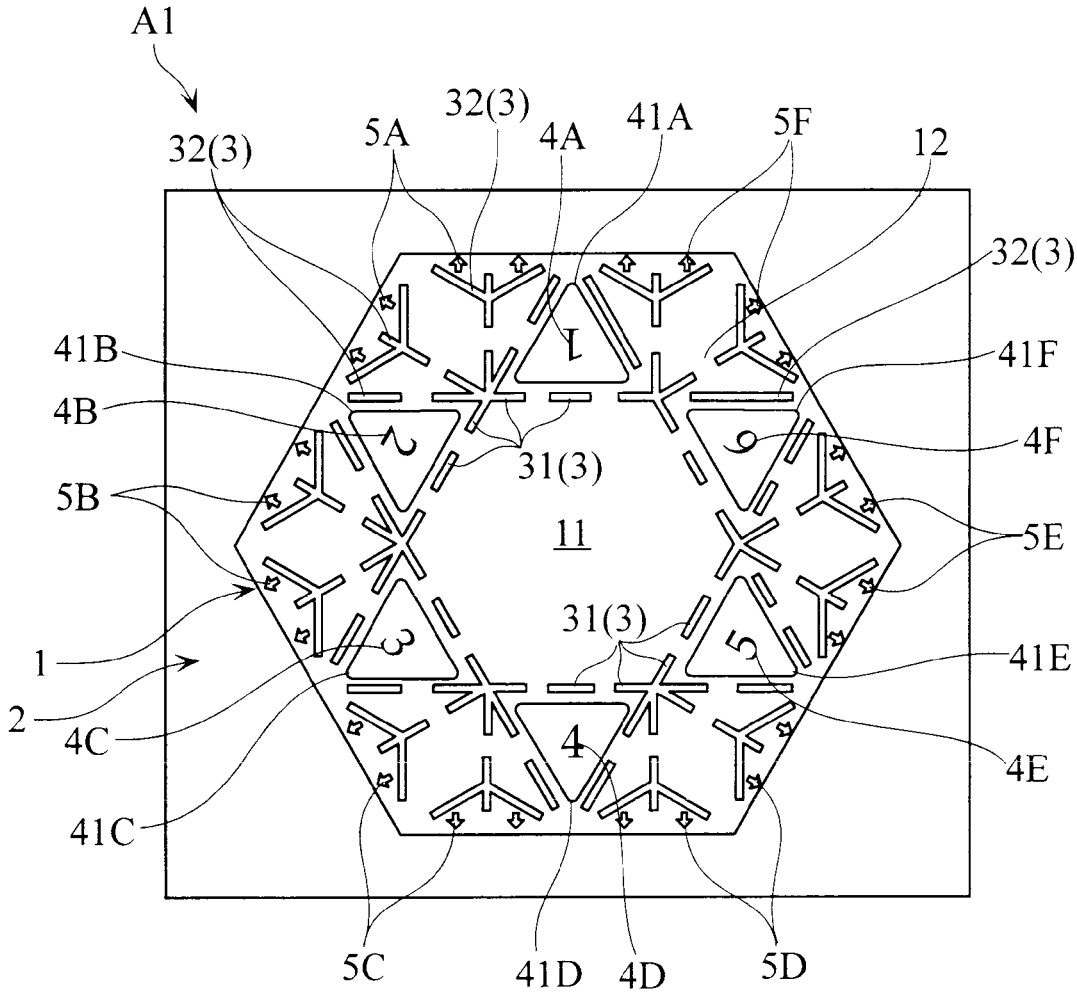
FIG. 1 is a plan view of a handicraft assisting tool according to a first embodiment of the present invention.

FIG. 1 is a plan view showing a handicraft assisting tool A1 according to a first embodiment of the present invention. The handicraft assisting tool A1 has a regular polygonal sheet body 1 and a release sheet 2 that is larger than the sheet body 1. As shown in the figure, the release sheet 2 is adhered to the sheet body 1 in the unused handicraft assisting tool A1.

The sheet body 1 is made of flexible paper and has a regular hexagonal outline. A lower surface of the sheet body 1 (surface contacting with the release sheet 2) is provided with an adhesive layer with a predetermined adhesive force. As will be described hereinafter, the sheet body 1 can be adhered to a fabric with this adhesive layer.

The sheet body 1 has a regular polygonal central region 11 and a peripheral region 12 provided outside the central region 11. The central region 11 has a similar shape to the shape of the sheet body 1 and is half the size of the sheet body 1. The center of the central region 11 matches the center of the sheet body 1. Also, each of the apexes of the central region 11 matches each of the apexes of the sheet body 1 in a circumferential direction. In other words, half lines extending from the center of the sheet body 1 through the apexes of the central region 11 are configured to pass through the corresponding apexes of the sheet body 1.

A plurality of slits 3 (31, 32) disposed along a predetermined folding line are formed in the sheet body 1. These slits 3 serve to facilitate an operation of folding the sheet body 1 (and the fabric to which the sheet body is adhered) along the folding line. As shown in FIG. 1, the slits 3 include a plurality of first slits 31 and a plurality of second slits 32. The first slits 31 are formed along a boundary between the central region 11 and the peripheral region 12 and configured to extend in a row along each side of the central region 11. The second slits 32, on the other hand, are formed in the peripheral region 12. Some of the second slits 32 extend linearly along an extension of each side of the central region 11 while others are communicated with each other in the vicinity of an outer periphery of the sheet body 1 to form branches.

On an upper surface of the sheet body 1, folding operation guiding means is shown in the peripheral region 12 by printing, for example. In the illustrated embodiment, this folding operation guiding means includes a plurality of number signs 4A through 4F and a plurality of arrow signs 5A through 5F. As will be described in detail hereinafter, each of the number signs 4A through 4F indicates an order in folding the fabric using the first slits 31, while each of the arrow signs 5A through 5F indicates a direction in which the fabric is to be folded using the second slits 32. Each of the number signs 4A through 4F is positioned in the vicinity of the first slits 31 so as to correspond to one of the sides of the central region 11. Also, the arrow signs 5A through 5F are each positioned in pair on both sides of each apex of the outline of the sheet body 1 in a sandwiching manner. Triangular folding region signs 41A through 41F are shown around the number signs 4A through 4F, respectively.

A surface section of the release sheet 2 that faces the sheet body 1 is applied with, for example, silicone resin so that the release sheet 2 can be released easily from the adhesive layer of the sheet body 1.

Next, a method for creating a motif using the handicraft assisting tool A1 is described with reference to FIG. 2 through FIG. 8.

Figure 2:
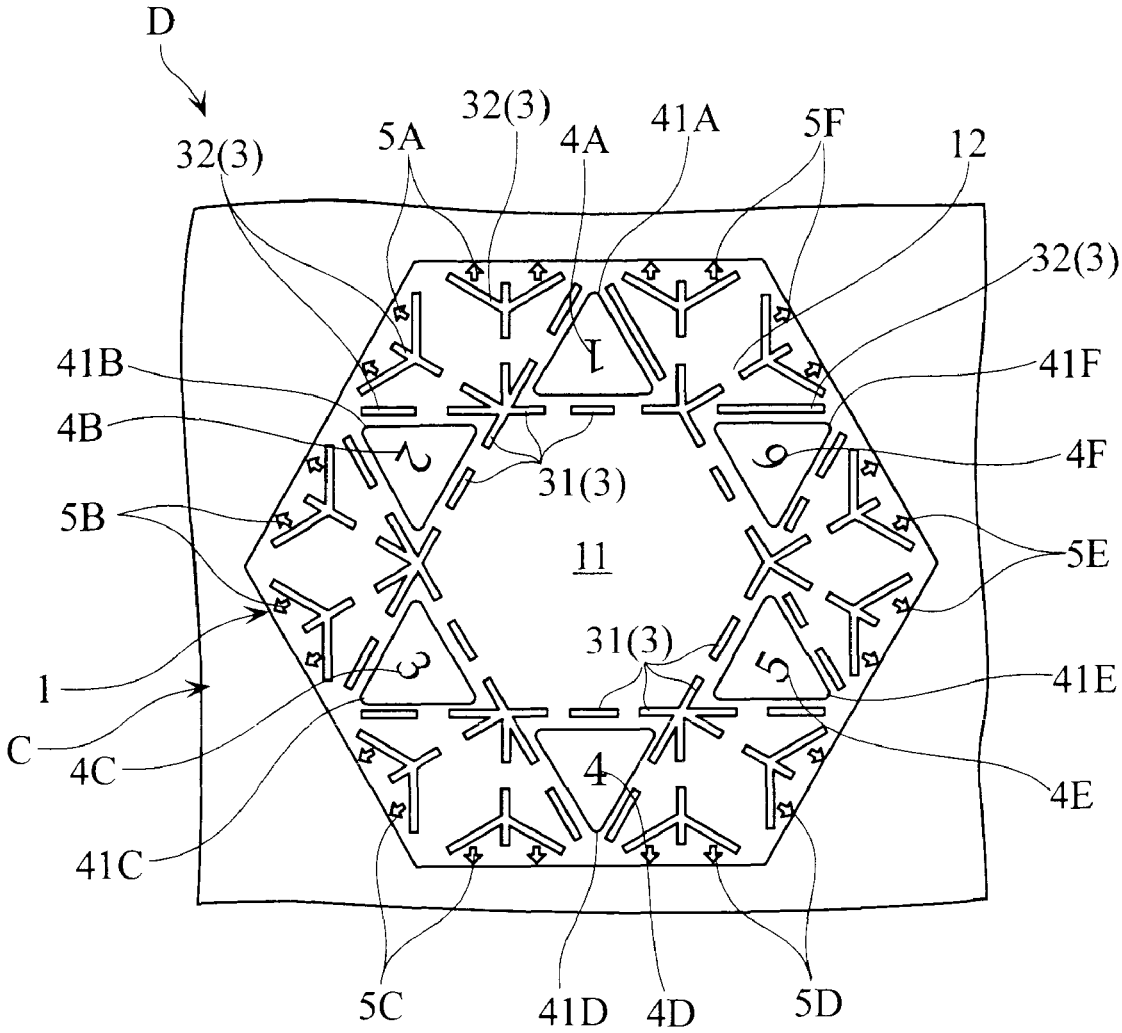
FIG. 2 is a plan view showing a step of usage of the handicraft assisting tool of the first embodiment.

First, the release sheet 2 is ripped from the sheet body 1 to adhere the sheet body 1 to a fabric C, as shown in FIG. 2. In the figure, an overlapped product of the sheet body 1 and fabric C is indicated as reference D. Next, an unwanted section of the fabric C is cut off along the outline of the sheet body 1. Unlike a conventional method where a paper pattern is used, this method is advantageous in that it is not necessary to place a cut mark on the fabric C. Moreover, the sheet body 1 is prevented from being misaligned on the fabric C. In addition, since the overlapped product D has appropriate stiffness, the work of cutting the fabric C can be performed easily.

Figure 3:
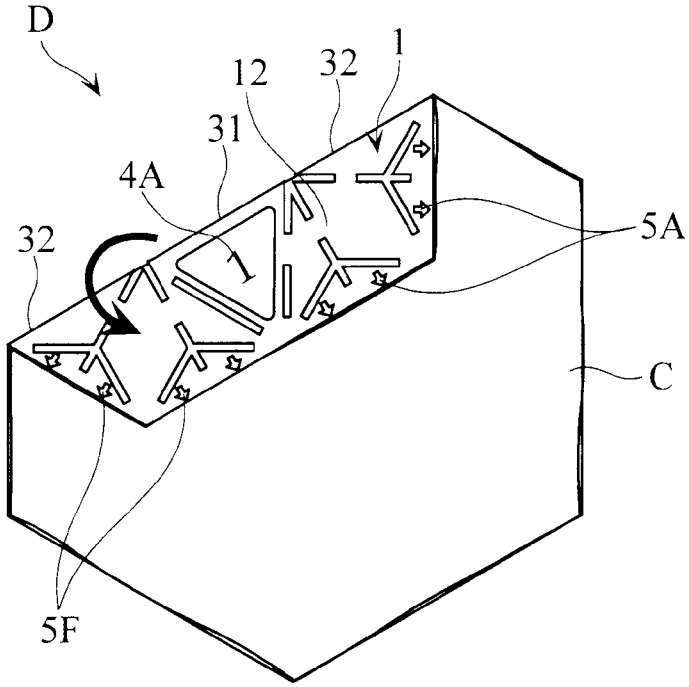
FIG. 3 is a plan view showing a step of usage of the handicraft assisting tool of the first embodiment.
Figure 4:
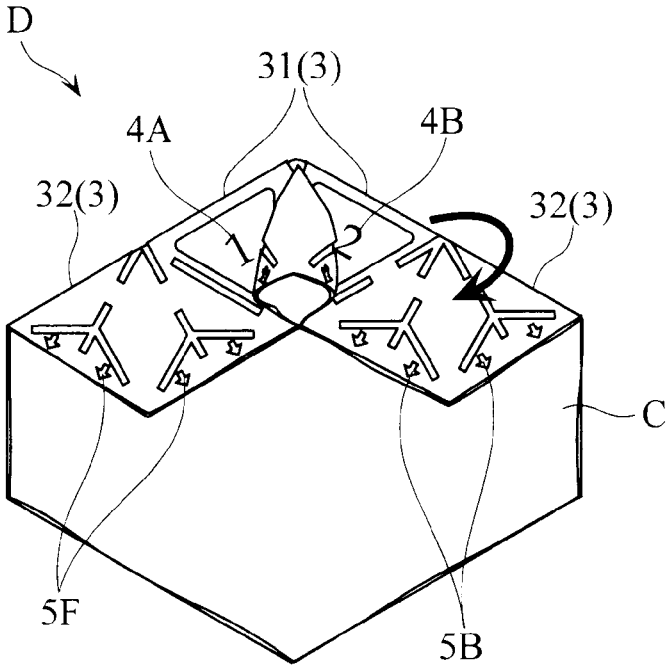
FIG. 4 is a plan view showing a step of usage of the handicraft assisting tool of the first embodiment.

Next, the overlapped product D is folded according to the slits 3 (the first slits 31 and the second slits 32), the number signs 4A through 4F, the arrow signs 5A through 5F, and the folding region signs 41A through 41F. Specifically, first the fabric C is reversed and the peripheral region 12 is folded so that the number sign 4A marked with a numeral "1" faces outward, as shown in FIG. 3. In so doing, the peripheral region 12 is folded along the first slit 31 corresponding to the number sign 4A and the second slits 32 connected linearly to this first slit 31. As described above, the central region 11 has a similar shape to the shape of the sheet body 1 and is half the size of the sheet body 1, and the center of the central region 11 matches the center of the unfolded sheet body 1. Therefore, a rim of the folded section passes through substantially the center of the central region 11. Subsequently, the section corresponding to the number sign 4B marked with a numeral "2" is folded in a similar manner along the corresponding first and second slits 31, 32, as shown in FIG. 4.

Figure 5:
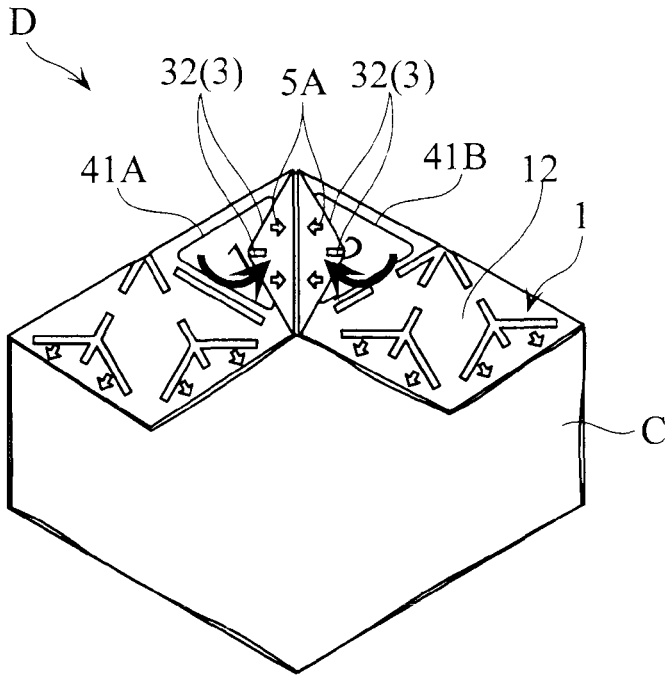
FIG. 5 is a plan view showing a step of usage of he handicraft assisting tool of the first embodiment.
Figure 6:
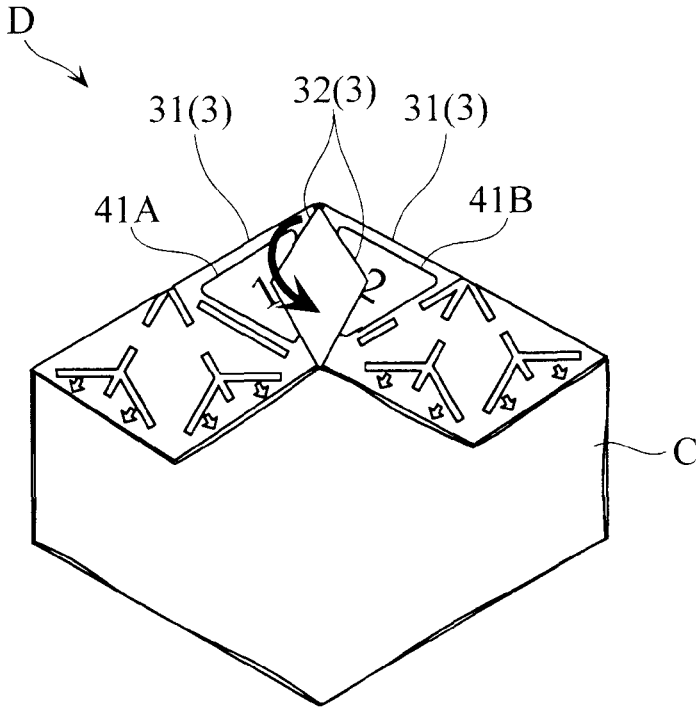
FIG. 6 is a plan view showing a step of usage of the handicraft assisting tool of the first embodiment.

Next, the second slits 32 are folded so as to form a rhombus by putting together the pairs of arrow signs 5A, 5A between the regions marked with the folding region signs 41A, 41B, as shown in FIG. 5. Then, as shown in FIG. 6, an upper half of the rhombus section is folded to near side along the second slits 32 positioned at the center of the rhombus section. The folded section is secured with a clip or the like according to need.

Figure 7:
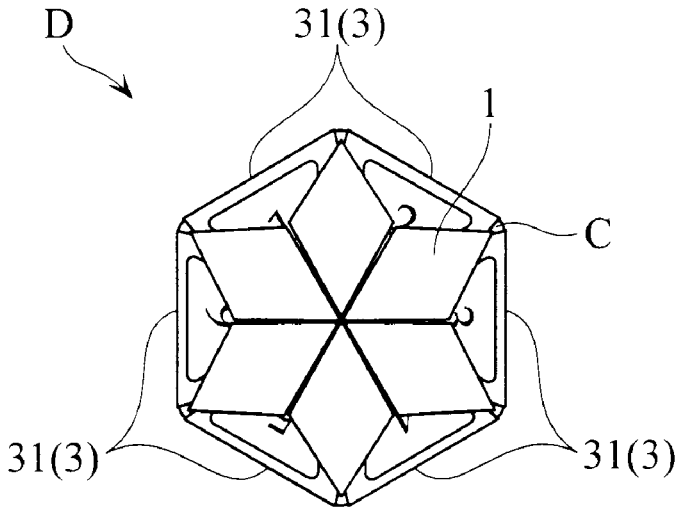
FIG. 7 is a plan view showing a step of usage of the handicraft assisting tool of the first embodiment.

Next, the operation of folding the overlapped product D along the first and second slits 31, 32 is performed similarly for the number signs 4C through 4F marked with numerals "3," "4," "5," and "6." As a result, the overlapped product D is folded into a predetermined configuration having rotational symmetry, as shown in FIG. 7.

The entire folded overlapped product D is ironed next. This ironing work is carried out in order to make a predetermined form of crease on the fabric C.

The folded overlapped product D is then unfolded and the sheet body 1 is ripped from the fabric C. Then, the fabric C is folded again along the crease, and the center thereof is stitched. As a result, a motif M1 having a hexagonal outline as shown in FIG. 8 is obtained.

In the handicraft assisting tool A1 described above, the plurality of slits 3 are formed on the sheet body 1 along predetermined folding lines. Therefore, when the motif M1 is created using the handicraft assisting tool A1, it is possible to easily perform the operation of folding the overlapped product D, which is obtained by integrating the fabric C and the sheet body 1, along the slits 3 (the first and second slits 31, 32). Since the overlapped product D with appropriate stiffness is subjected to this folding operation, the overlapped product D can be folded along the predetermined folding lines more accurately than when the fabric C alone is folded. Furthermore, only the overlapped product D that is folded into a predetermined configuration (see FIG. 7) may be ironed in the above embodiment. Therefore, unlike the conventional method in which the fabric needs to be ironed in every folding step, creases can be formed on the fabric efficiently. In this manner, the desired motif M1 can be created easily and efficiently by using the handicraft assisting tool A1.

Also, in the above embodiment, the number signs 4A through 4F and the arrow signs 5A through 5F are shown in the peripheral region 12 of the sheet body 1. By continuing the operation of folding the first and second slits 31, 32 based on these descriptions 4A through 4F and 5A through 5F, the motif M1 can be created easily.

Figure 8:
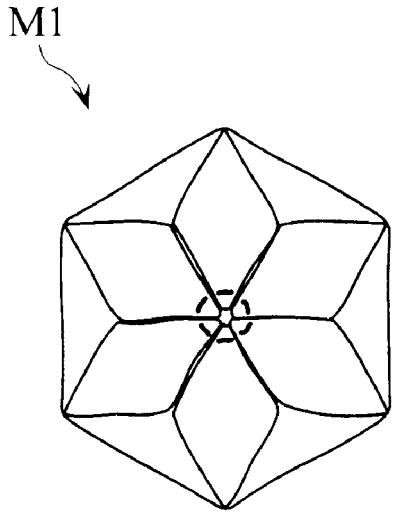
FIG. 8 is a plan view showing a motif created by using the handicraft assisting tool of the first embodiment.

As is understood from the FIG. 2, FIG. 7 and FIG. 8, the motif M1 having the same outline as the central region 11 of the sheet body 1 is obtained in the above embodiment. Also, the central region 11 is half the size of the entire sheet body 1 and the center of the central region 11 matches the center of the unfolded sheet body 1. Therefore, a rim section of the fabric that corresponds to the folded peripheral region 12 of the sheet body 1 concentrates in the center of the motif M1. Hence, the form of the motif M1 can be maintained by stitching this central section.

The release sheet 2 may be adhered to the adhesive layer of the sheet body 1 again after the sheet body 1 is used, and thus handling of the sheet body 1 is facilitated at the time of storage and the like. Moreover, the sheet body 1 can be repeatedly used until the adhesive force of the adhesive layer deteriorates.

FIG. 9 through FIG. 19 show handicraft assisting tools according to second through fifth embodiments of the present invention. Note in these figures that the same reference numerals are applied to the same or similar elements as or to those of the first embodiment, and thus explanations of these same or similar elements are omitted.

Figure 9:
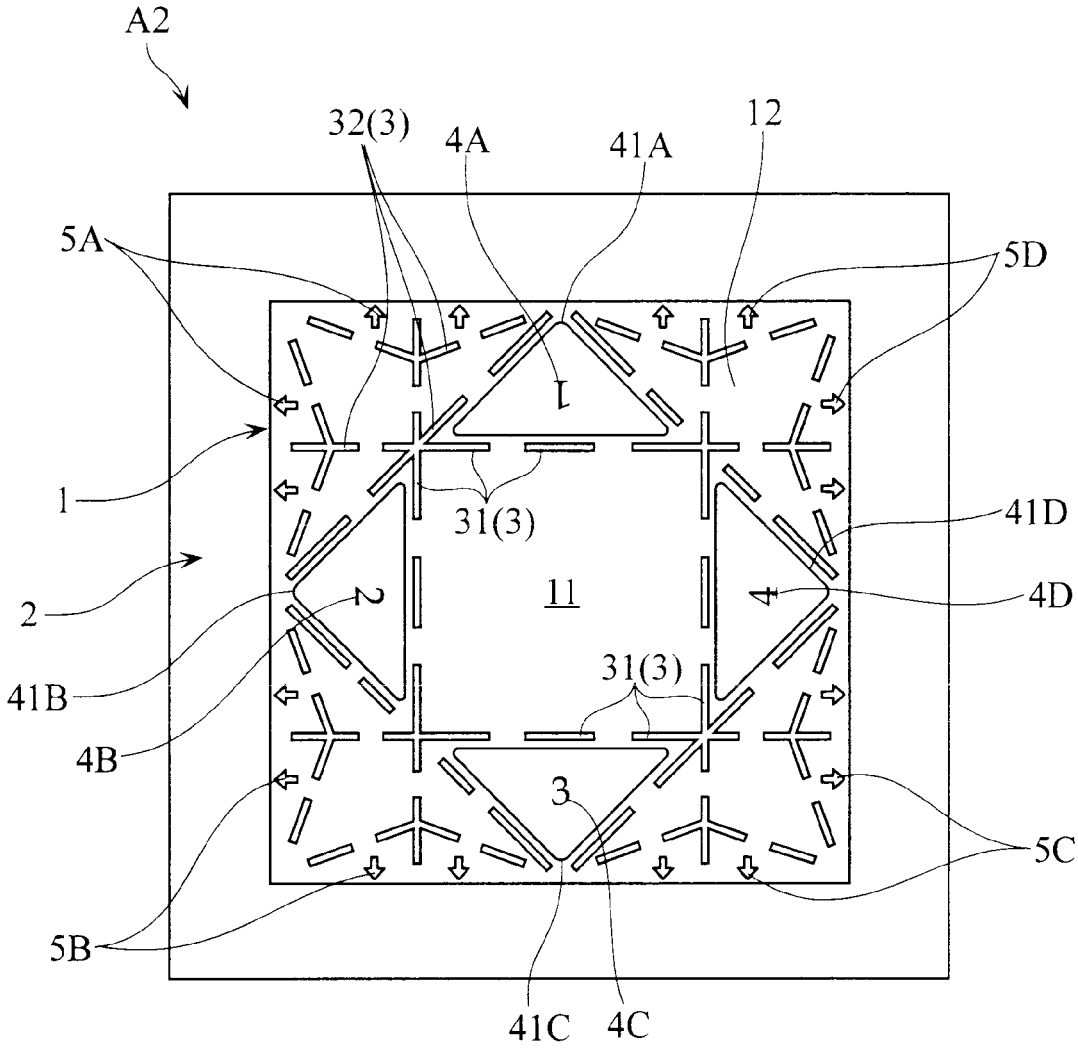
FIG. 9 is a plan view of a handicraft assisting tool according to a second embodiment of the present invention.

FIG. 9 shows a handicraft assisting tool A2 according to the second embodiment of the present invention. The handicraft assisting tool A2 is basically the same as the handicraft assisting tool A1 of the first embodiment but is different from the handicraft assisting tool A1 in that the outline of the sheet body 1 of the handicraft assisting tool A1 has a square shape (as well as those parts that are changed in various ways due to the change of this outline).

Figure 10:
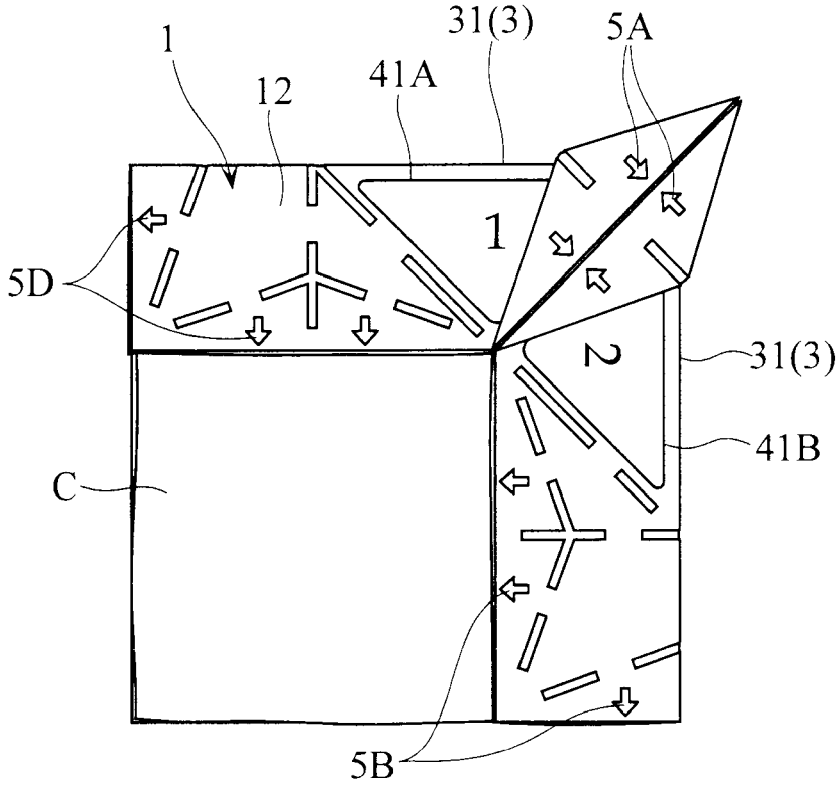
FIG. 10 is a plan view showing a step of usage of the handicraft assisting tool of the second embodiment.

When creating a motif using the handicraft assisting tool A2, the overlapped product that is obtained by adhering the sheet body 1 to the fabric C is folded based on the first and second slits 31, 32, the number signs 4A through 4D, the arrow signs 5A through 5D, and the folding region signs 41A through 41D, similarly to the first embodiment. FIG. 10 shows a step of creating the motif by using the handicraft assisting tool A2 corresponding to the step shown in FIG. 5.

Figure 11:
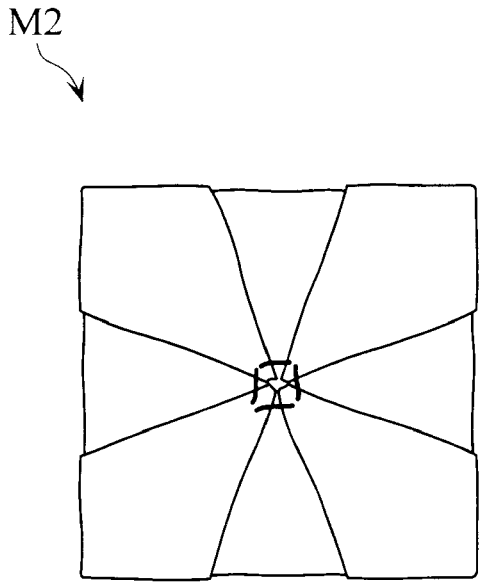
FIG. 11 is a plan view showing a motif created by using the handicraft assisting tool of the second embodiment.

FIG. 11 shows a motif M2 that is created using the handicraft assisting tool A2. The motif M2 having a square outline can be created by using the handicraft assisting tool A2.

Figure 12:
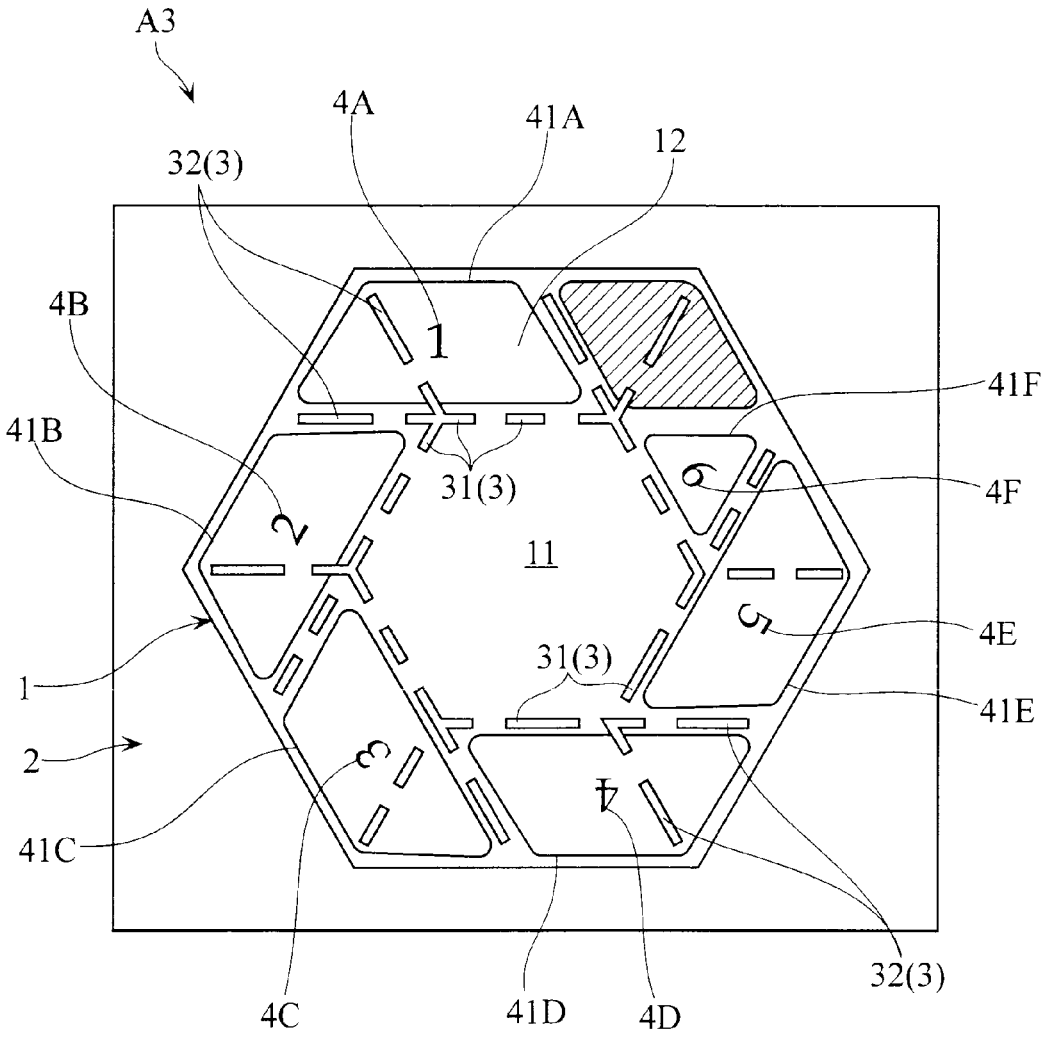
FIG. 12 is a plan view of a handicraft assisting tool according to a third embodiment of the present invention.

FIG. 12 shows a handicraft assisting tool A3 according to the third embodiment of the present invention. Similarly to the handicraft assisting tool A1 of the first embodiment, the sheet body 1 of the handicraft assisting tool A3 has a regular hexagonal shape. However, the folding method in which the handicraft assisting tool A3 is used is different from that of the first embodiment. Specifically, the folding method of the handicraft assisting tool A3 is simpler than that of the handicraft assisting tool Al and the handicraft assisting tool A3 does not show any arrow signs.

Figure 13:
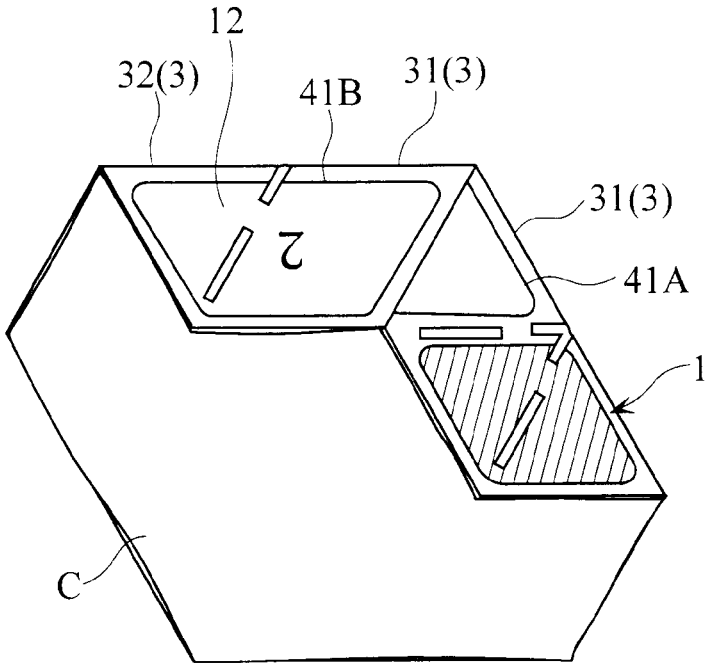
FIG. 13 is a plan view showing a step of usage of the handicraft assisting tool of the third embodiment.
Figure 14:
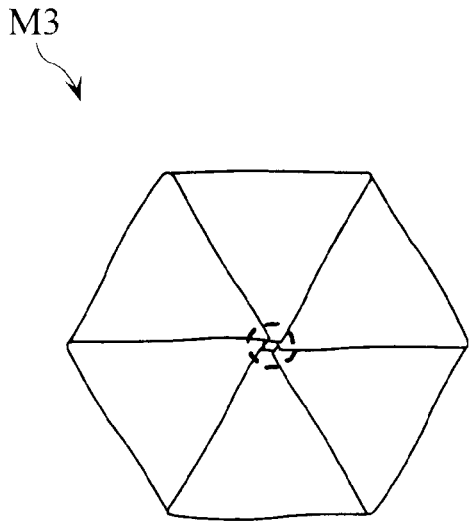
FIG. 14 is a plan view showing a motif created by using the handicraft assisting tool of the third embodiment.

When creating a motif using the handicraft assisting tool A3, the overlapped product that is obtained by adhering the sheet body 1 to the fabric C is folded based on the first and second slits 31, 32, the number signs 4A through 4F, and the folding region descriptions 41A through 41F. FIG. 13 shows a step of creating the motif by using the handicraft assisting tool A3 corresponding to the step shown in FIG. 5. When folding a region corresponding to the number sign 4F marked with a numeral "6", the hatched region is folded into a valley shape so as to be positioned below a folded section corresponding to the number sign 4A marked with a numeral "1". Here, since the overlapped product is stiff, the hatched region can be folded relatively easily. FIG. 14 shows a motif M3 that is created using the handicraft assisting tool A3. The motif M3 having a regular hexagonal outline can be created by using the handicraft assisting tool A3.

Figure 15:
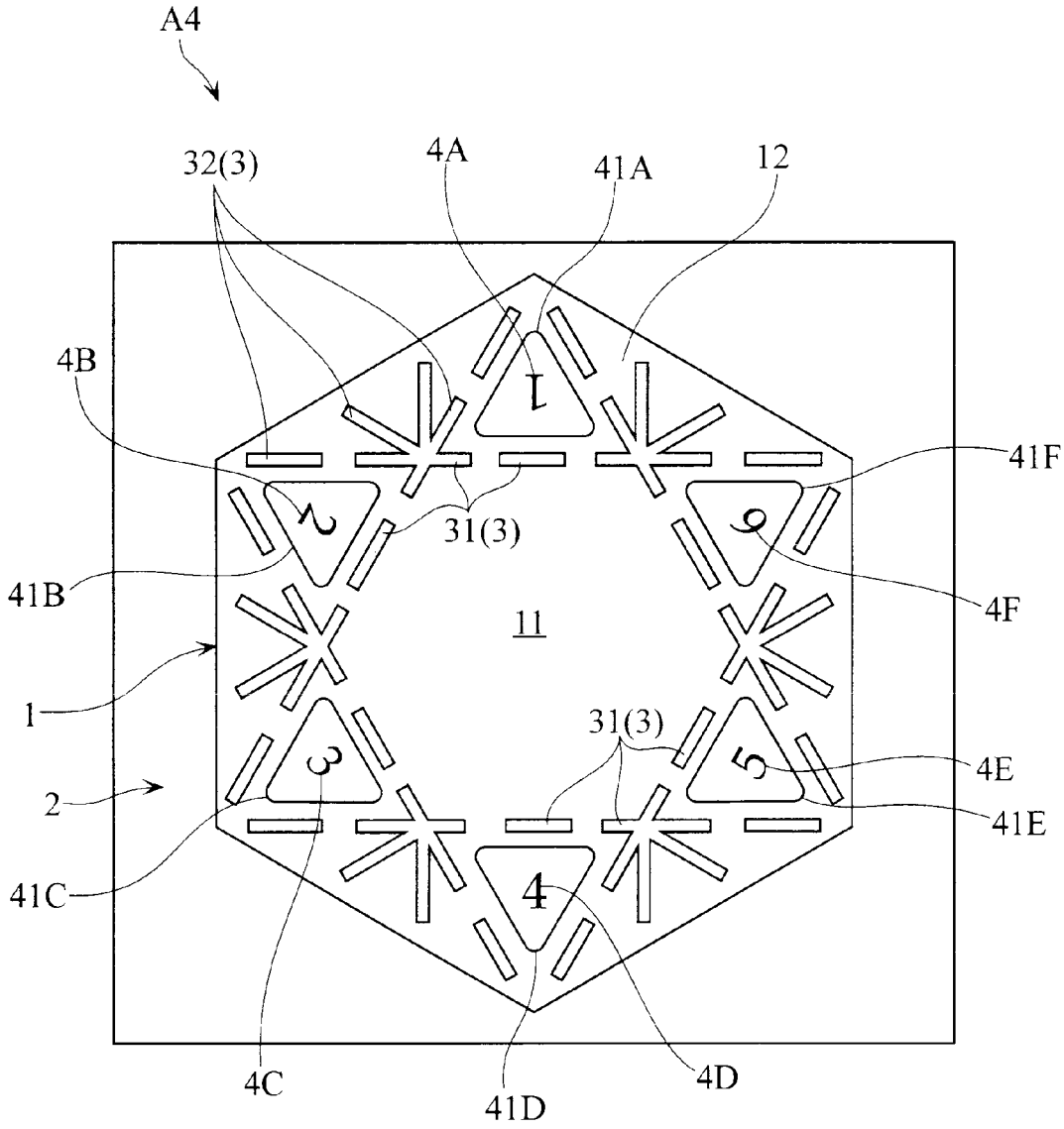
FIG. 15 is a plan view of a handicraft assisting tool according to a fourth embodiment of the present invention.

FIG. 15 shows a handicraft assisting tool A4 according to the fourth embodiment of the present invention. Similarly to the handicraft assisting tool A1 of the first embodiment, the sheet body 1 of the handicraft assisting tool A4 has a regular hexagonal shape. However, the folding method when using the handicraft assisting tool A4 is different from that of the first embodiment. Specifically, the folding method of the handicraft assisting tool A4 is simpler than that of the handicraft assisting tool A1 and the handicraft assisting tool A4 does not show any arrow signs. Also, although the central region 11 of the sheet body 1 is a miniature version of the sheet body 1, each of the apexes of the central region 11 are misaligned from each of the apexes of the regular hexagon configuring the outline of the sheet body 1 in the circumferential direction.

Figure 16:
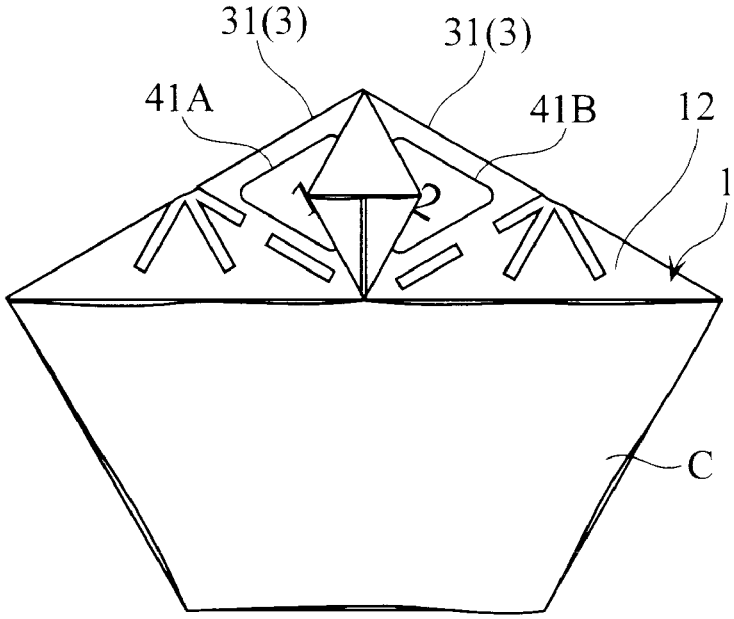
FIG. 16 is a plan view showing a step of usage of the handicraft assisting tool of the fourth embodiment.
Figure 17:
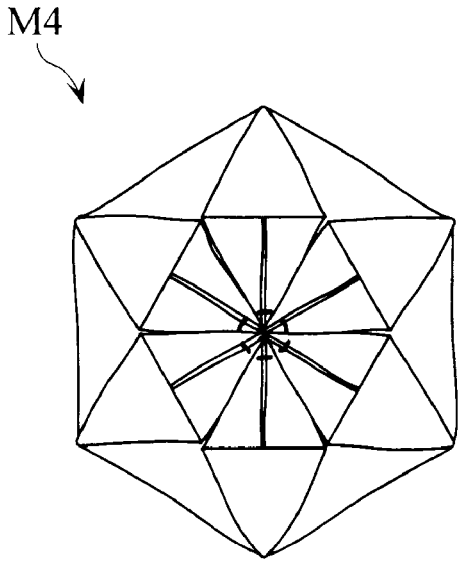
FIG. 17 is a plan view showing a motif created by using the handicraft assisting tool of the fourth embodiment.

When creating a motif using the handicraft assisting tool A4, the overlapped product that is obtained by adhering the sheet body 1 to the fabric C is folded based on the first and second slits 31, 32, the number signs 4A through 4F, and the folding region signs 41A through 41F. FIG. 16 shows a step of creating the motif by using the handicraft assisting tool A4 corresponding the step shown in FIG. 5. As is understood from FIG. 16, the apexes of the outline, of the sheet body 1 are positioned in the center of the central region 11. FIG. 17 shows a motif M4 that is created using the handicraft assisting tool A4. The motif M4 having a regular hexagonal outline can be created by using the handicraft assisting tool A4.

Figure 18:
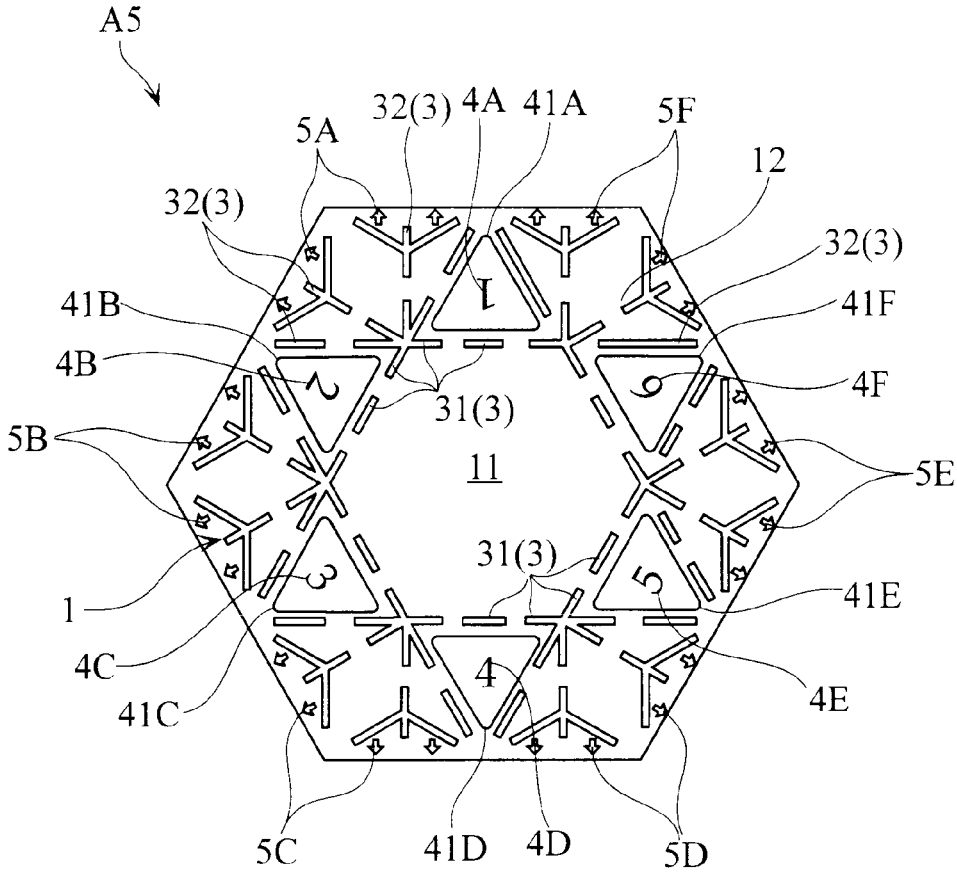
FIG. 18 is a plan view of a handicraft assisting tool according to a fifth embodiment of the present invention.

FIG. 18 shows a handicraft assisting tool A5 according to the fifth embodiment of the present invention. The handicraft assisting tool A5 is same as the handicraft assisting tool A1 of the first embodiment in terms of the shape of the sheet body 1 but is different from the handicraft assisting tool A1 in that-the handicraft assisting tool A5 does not have a release sheet (as well as those parts that are changed in various ways due to the unprovided release sheet).

In the handicraft assisting tool A5, a thermal adhesive layer is formed on the back of a sheet-like nonwoven layer of the sheet body 1 (on a surface that is not shown in FIG. 18). As with the handicraft assisting tool A1 of the first embodiment, the first and second slits 31, 32 are formed on the sheet body 1 of the handicraft assisting tool A5. Also, the number signs 4A through 4F, arrow signs 5A through 5F, and folding region signs 41A through 41F are shown on a obverse surface of the nonwoven layer (the surface shown in FIG. 18).

When creating a motif using the handicraft assisting tool A5, first the sheet body 1 is adhered to a fabric. In order to do so, the sheet body 1 is superimposed on the fabric so as to bring the thermal adhesive layer into contact with the fabric, and then thus obtained overlapping product is ironed. After the sheet body 1 is adhered to the fabric, an unwanted section of the fabric is cut along the outline of the sheet body 1.

Figure 19:
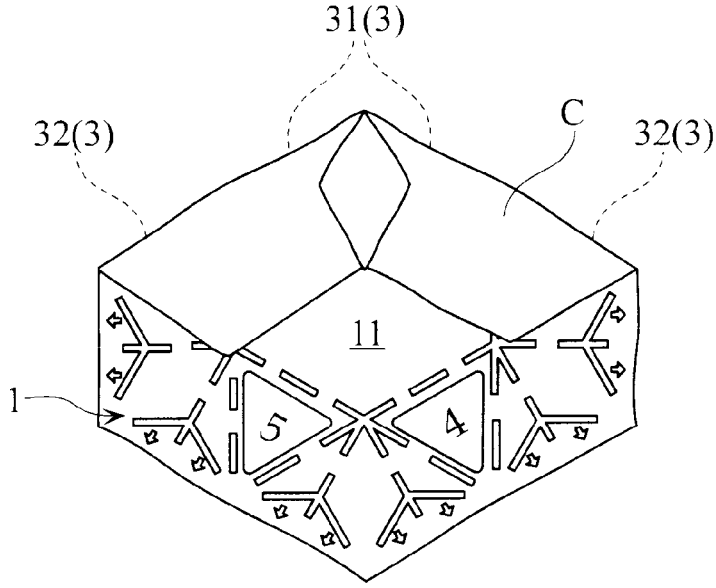
FIG. 19 is a plan view showing a step of usage of the handicraft assisting tool of the fifth embodiment.

Next, the overlapped product that is obtained by adhering the sheet body 1 to the fabric C is folded based on the first and second slits 31, 32, number signs 4A through 4F, arrow signs 5A through 5F, and folding region signs 41A through 41F. At this moment, unlike the handicraft assisting tool A1 of the first embodiment, the first and second slits 31, 32 are folded so that the sections marked with the number signs 4A through 4F face inward. FIG. 19 shows a step of creating the motif by using the handicraft assisting tool A5 corresponding to the step shown in FIG. 6. In the case of the fifth embodiment, the overlapping product that is folded into a predetermined configuration directly forms the motif, and the sheet body 1 remains inside of the motif.

The invention claimed is:

1. A handicraft assisting tool folding a fabric into a configuration having rotational symmetry, the handicraft assisting tool comprising:

a flexible sheet body adhered to the fabric; and a folding facilitator formed on the sheet body;

wherein the folding facilitator facilitates an operation of folding an overlapped product along a predetermined folding line, the overlapped product being obtained by adhering the fabric to the sheet body; and wherein the sheet body is provided with a plurality of number signs indicating an order of folding the overlapped product and a plurality of arrow signs indicating directions in which the overlapped product is to be folded.

2. The handicraft assisting tool according to claim 1, wherein the folding facilitator includes a plurality of slits disposed along the folding line.

3. The handicraft assisting tool according to claim 1, wherein the sheet body has an outline shaped as a regular polygon.

4. The handicraft assisting tool according to claim 3, wherein the sheet body includes a central region in a similar shape to the regular polygon and a peripheral region surrounding the central region, and wherein the folding facilitator includes a plurality of first slits disposed along a boundary between the central region and the peripheral region.

5. The handicraft assisting tool according to claim 4, wherein the folding facilitator further includes a plurality of second slits formed in the peripheral region, and wherein one of the plurality of second slits and one of the plurality of first slits are disposed collinear.

6. The handicraft assisting tool according to claim 4, wherein the central region is half a size of the sheet body, and wherein a straight line passing through one apex of the central region and a corresponding apex of the sheet body passes through a center of the sheet body.

7. The handicraft assisting tool according to claim 1, further comprising a release sheet attached to the sheet body, wherein the sheet body is provided with an adhesive layer to be adhered to the fabric and the release sheet.

8. The handicraft assisting tool according to claim 1, wherein the sheet body includes a nonwoven layer and a thermal adhesive layer laminated on the nonwoven layer.

9. A handicraft assisting tool folding a fabric into a configuration having rotational symmetry, the handicraft assisting tool comprising:

a flexible sheet body adhered to the fabric; and a folding facilitator formed on the sheet body;

wherein the folding facilitator facilitates an operation of folding an overlapped product along a predetermined folding line, the overlapped product being obtained by adhering the fabric to the sheet body;

wherein the sheet body has an outline shaped as a regular polygon;

wherein the sheet body includes a central region in a similar shape to the regular polygon and a peripheral region surrounding the central region; and wherein the folding facilitator includes a plurality of first slits disposed along a boundary between the central region and the peripheral region.

10. The handicraft assisting tool according to claim 9, wherein the folding facilitator includes a plurality of slits disposed along the folding line.

11. The handicraft assisting tool according to claim 9, wherein the folding facilitator further includes a plurality of second slits formed in the peripheral region, and wherein one of the plurality of second slits and one of the plurality of first slits are disposed collinear.

12. The handicraft assisting tool according to claim 9, wherein the central region is half a size of the sheet body, and wherein a straight line passing through one apex of the central region and a corresponding apex of the sheet body passes through a center of the sheet body.

13. The handicraft assisting tool according to claim 9, further comprising a release sheet attached to the sheet body, wherein the sheet body is provided with an adhesive layer to be adhered to the fabric and the release sheet.

14. The handicraft assisting tool according to claim 9, wherein the sheet body includes a nonwoven layer and a thermal adhesive layer laminated on the nonwoven layer.

15. A handicraft assisting tool folding a fabric into a configuration having rotational symmetry, the handicraft assisting tool comprising:

a flexible sheet body adhered to the fabric; and a folding facilitator formed on the sheet body;

wherein the folding facilitator facilitates an operation of folding an overlapped product along a predetermined folding line, the overlapped product being obtained by adhering the fabric to the sheet body; and wherein the sheet body includes a nonwoven layer and a thermal adhesive layer laminated on the nonwoven layer.

* * * * *